United States Patent [19]

John et al.

[11] 4,234,151

[45] Nov. 18, 1980

[54] SELF-LOCKING ADJUSTABLE SUPPORT DEVICES

[76] Inventors: Alfryn I. John, 3 Waubant Rd., Kenfig Hill, Glamorgan; Jack H. Moxham, 19 Birchwalk, Newton, Porthcawl, Mid Glamorgan, both of Wales

[21] Appl. No.: 34,379

[22] Filed: Apr. 30, 1979

[51] Int. Cl.[3] ..... E04G 25/00; F16M 13/00

[52] U.S. Cl. ..... 248/354 S; 248/354 R; 248/412; 403/369

[58] Field of Search ..... 248/354 S, 354 P, 354 R, 248/405, 412; 403/368, 369; 254/98, 102

[56] References Cited

U.S. PATENT DOCUMENTS

| | | | |
|---|---|---|---|
| 2,192,079 | 2/1940 | Hinselmann | 248/354 S |
| 2,297,469 | 9/1942 | Groetschel | 248/354 R |
| 2,532,168 | 11/1950 | Jakoubek | 248/354 R |
| 2,658,777 | 11/1953 | Rauglas | 248/412 X |
| 2,703,691 | 3/1955 | Minnis | 248/412 |
| 2,903,226 | 9/1959 | Haveloose | 248/354 B |
| 3,292,892 | 12/1966 | Abbott | 248/354 R |
| 3,326,791 | 6/1967 | Heuse | 403/369 X |

FOREIGN PATENT DOCUMENTS

| | | | |
|---|---|---|---|
| 519245 | 5/1953 | Belgium | 248/354 |
| 831386 | 7/1949 | Fed. Rep. of Germany | 248/354 S |
| 322619 | 12/1929 | United Kingdom . | |
| 376063 | 7/1932 | United Kingdom . | |

*Primary Examiner*—James T. McCall

*Attorney, Agent, or Firm*—Bucknam and Archer

[57] ABSTRACT

A self-locking adjustable support device comprising two telescopically interfitting members, a housing and a means for connecting the housing to one of the telescopically interfitting members in a manner permitting the housing to be adjusted in position longitudinally relative to one member. The housing is formed with a portion having an internal frusto-conical surface arranged to receive a plurality of locking elements which can be jammed between the frusto-conical surface and the outer surface of the said one member to inhibit movement of said other member in one direction longitudinally relative to said one member. The connecting means is a screwthreaded member which permits rotation of the housing relative to one member to afford fine adjustment of the overall length of the support device.

9 Claims, 4 Drawing Figures

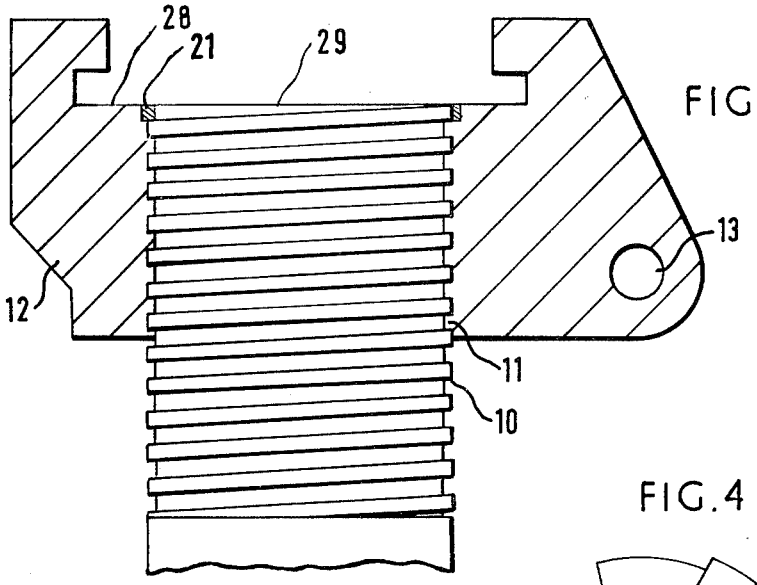
FIG. 2.
FIG. 4.
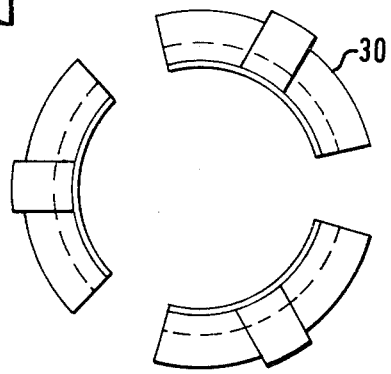
FIG. 3.
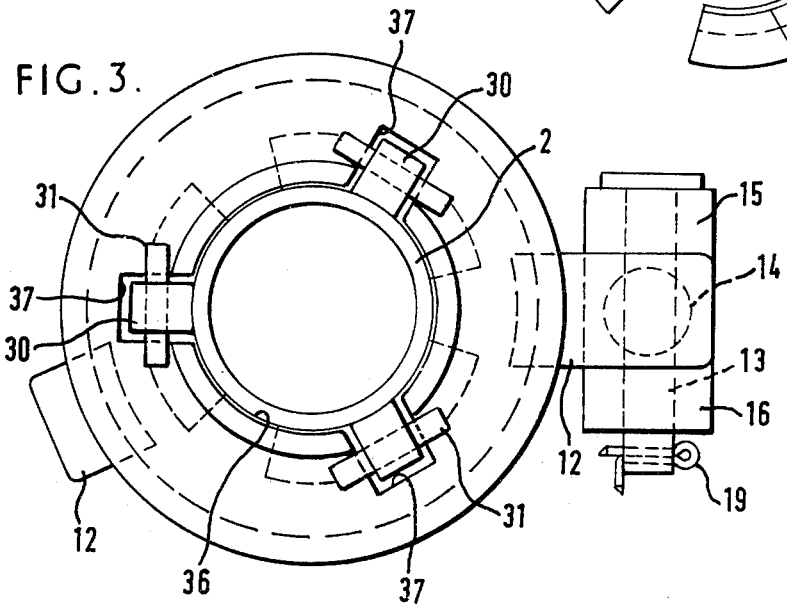

SELF-LOCKING ADJUSTABLE SUPPORT DEVICES

TECHNICAL FIELD OF THE INVENTION

This invention relates to self-locking adjustable support devices and more particularly, but not exclusively, to self-locking adjustable props for use in mines, on building sites, in trenches and in similar applications, and to adjustable self-locking mechanisms for use with such devices.

BACKGROUND ART

With adjustable support devices as previously proposed difficulty is experienced in initially striking the device so that it approximates to the desired overall length and in the subsequent final adjustment of the device to that desired length.

An object of the invention is to provide a support device in which the initial and final adjustment can be carried out by a single operator by means of and adjustment mechanism located at a convenient position along the length of the support device.

DISCLOSURE OF THE INVENTION

According to the present invention a self-locking adjustable support device comprises two telescopically interfitting members, a housing, and means connecting the housing to one end of one of said telescopically interfitting members in a manner permitting the housing to be adjustable in position longitudinally relative to said one member, said housing being formed with a portion having an internal frusto-conical surface adapted to receive therein a plurality of locking elements, said locking elements capable of being jammed between said internal surface of the housing and the outer surface of the other of said members so as to inhibit movement of said other member in one direction longitudinally relative to said one member, said connecting means permitting rotation of said housing relative to said one member about its longitudinal axis to permit adjustment of the overall length of the support device.

The invention also contemplates the provision of an adjustable self-locking mechanism for use in association with support devices of the type described and comprising telescopically interfitting members, said mechanism comprising a housing adapted to be connected to one end of the outer one of said telescopically interfitting members in a manner permitting said housing to be adjustable in position longitudinally relative to the other of said members to permit adjustment of the overall length of said support device, said housing having an internal frusto-conical surface and a plurality of locking elements adapted to be conjointly moved into the space between and operable to effect a jamming connection between said internal frusto-conical surface of said housing and the other surface of the other of said telescopically interfitting members whereby to inhibit relative movement therebetween.

The telescopically interfitting members may, for example, comprise an extension member constituting said one member and a hollow section post constituting the other of said members, the internal dimensions of which post are such as to receive the extension member for sliding movement therewithin. The telescopically interfitting members may be of any suitable cross-sectional configuration, for example, a round, rectangular or polygonal cross-section.

The locking elements are preferably in the form of wedge-shaped members which upon insertion in the space between the internal surface of said housing and the outer surface of said extension member are effective to wedge said extension member and thereby inhibit relative movement thereof relative to said housing and consequently to said post to which said housing is connected.

An embodiment of the invention will now be described, by way of example, with reference to the accompanying drawings.

BRIEF DESCRIPTION OF THE DRAWINGS

FIG. 2 is a longitudinal view of a detail, partly in section, of the adjusting nut and post member of FIG. 1 incorporating means for preventing total screw off of the adjusting nut;

FIG. 3 is a top plan view showing a locking and adjusting mechanism in accordance with the invention; and FIG. 4 is a top plan view of locking elements as incorporated in the exemplary embodiment.

BEST MODE FOR CARRYING OUT THE INVENTION

Figure 1:
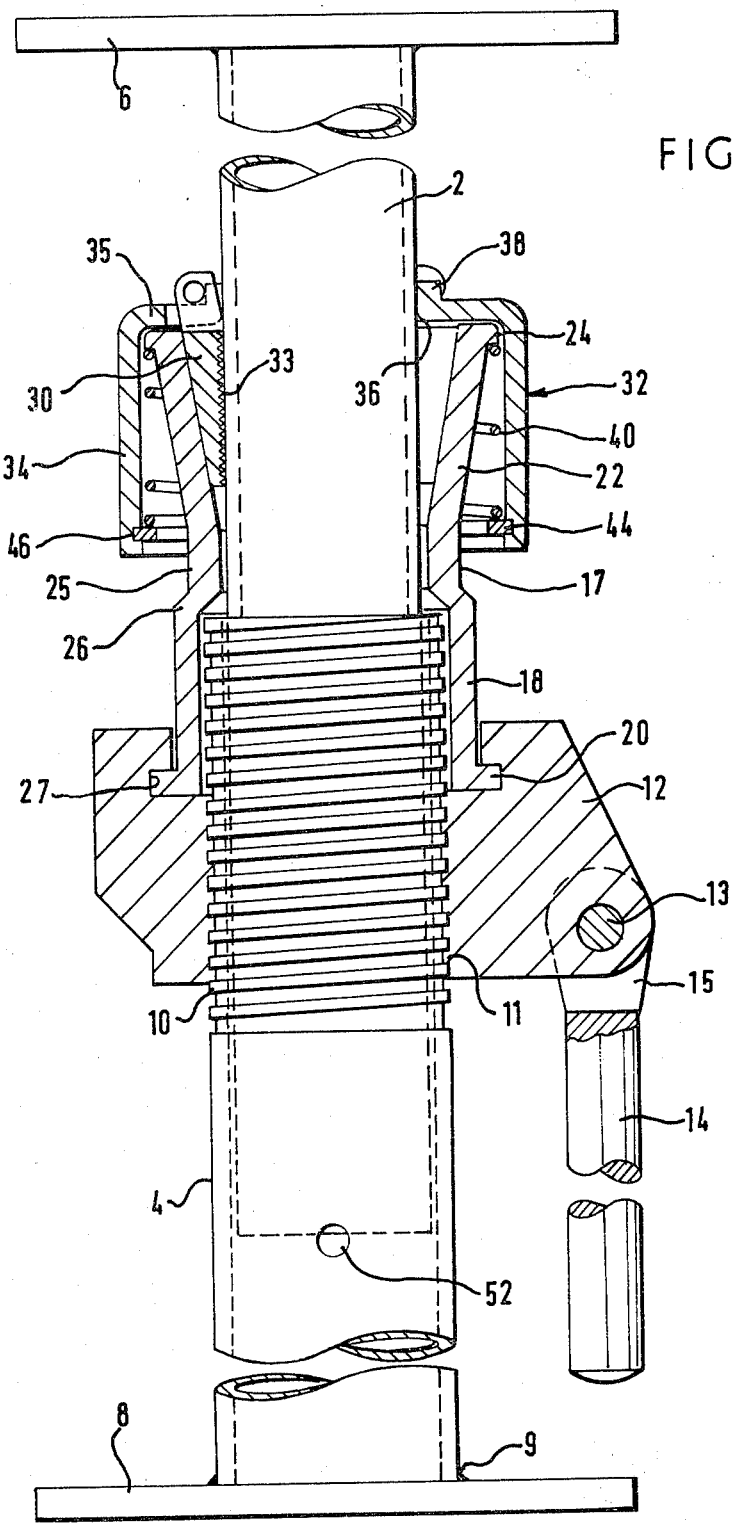
FIG. 1 is a longitudinal view, partly in section, showing the invention embodied as an adjustable prop.

Referring to the drawings, the support device, which in the embodiment illustrated is a self-locking adjustable prop, employs two telescopically interfitting members designated 2 and 4, respectively. The members 2 and 4 may conveniently be appropriate lengths of standard, commercially available, scaffold tubing and each tube is provided at one end with an end plate, 6 and 8 respectively. Whilst in the exemplary embodiment illustrated the members 2 and 4 are shown as round tubes it is to be noted that they may be of other configurations; for example they may be of rectangular or polygonal cross-section. The end plates, 6 and 8, may be attached to their associated tube either fixedly in the manner illustrated, as for example by welding at 9, or, removably in any suitable manner known per se.

At its end remote from end plate 8 and extending inwardly therefrom the outer tube 4 is provided with an externally threaded section 10 and the inner tube 2 forms a slidable fit within outer tube 4 to permit telescoping of the tubes one within the other.

An adjusting nut 12 having an internal thread 11 is threadedly engaged with the upper threaded portion 10 of outer tube 4 and movable along the length thereof. A handle member 14, bifurcated at 15, 16 is pivotally connected to the adjusting nut 12 by means of a pin 13 passed through apertures formed in the bifurcated end portions 15, 16 and secured therein by a split pin 19. A collar 17 formed at one end with a generally cylindrical portion 18 terminates at its free end in a flange 20 and at its other end in a frusto-conical portion 22 constituting a housing for receiving locking elements as will be described hereinafter, said housing terminating at its free end in a flange 24. The inner end of the frusto-conical portion 22 merges into a short, cylindrical portion 25 of the same cross-section as the small end of the frusto-conical portion 22 and is interconnected through a shoulder portion 26 with the cylindrical portion 18. The flange 20 is fixedly, though rotatably, received in a groove 27 formed in the adjusting nut 12.

It may be desirable in some applications to ensure that the adjusting nut 12 cannot be inadvertently uncoupled from the post 4 once mounted thereon. This may be accomplished in a simple and efficient manner by, as shown in FIG. 2, building a weld 21 into the outer terminal edge of the thread 10 using only sufficient weld to ensure that the adjusting nut 12 cannot be screwed in a direction of post 4 beyond the position shown in FIG. 2 whereat the top faces 28, 29 of the adjusting nut 12 and the threaded end of the post 4, respectively, are flush.

The tubes 2 and 4 are adapted to be lockably interconnected by means of locking elements which, in the embodiment shown, consist of wedges, 30, pivotally connected to, by pins 31, and extending within a cover member 32. In the embodiment shown three equi-spaced wedges 30 are provided. The cover member 32 comprises an annular skirt 34 and an end plate 35 formed with a central aperture 36 and equi-spaced recesses 37 extending outwardly therefrom and through which the locking elements 30 depend to within the annular skirt 34. A short cylindrical neck portion, 38, extends from the edge of the aperture 36 in a direction parallel to and away from skirt 34 and snugly circumjaces the outer surface of the inner tube 2 when the cover 32 is mounted thereon.

The locking elements, i.e. the wedges 30 are preferably made of metal with either the whole wedge or at least the gripping surfaces thereof suitably case hardened, sherardised or otherwise treated to ensure that the gripping surfaces are harder than the material which they are to engage or into which they are to bite or grip i.e. the outer surface of outer tube 4 and the inner surface of the frusto-conical portion 22 of the collar 17. Also as in the exemplary embodiment shown in the drawings gripping surfaces 33 may be serrated or otherwise roughened to improve their gripping capabilities. Suitably the wedges are castings of, for example, S.G. iron containing 1.5–2.0% nickel.

A suitable resilient means which may, for example, as in the embodiment shown, comprise a spring 40, is disposed around and extends longitudinally of the outer surface of the frusto-conical portion 22 and within the cover member 32 being retained therein by its engagement at one end with the flange 24 and by its engagement at its other end with a circlip 44 inserted in a groove 46 formed in the inner wall of skirt 34 adjacent the open end thereof.

The spring 40 is normally effective to bias collar 17 and consequently the locking elements, i.e. the wedges 30, in a direction relative to the housing into a position whereat their inner gripping surfaces, which are preferably serrated or faced with non-slip material or machined to provide non-slip surfaces, grippingly engage the outer surface of the inner tube 2 and effectively interlock the inner and outer tubes, 2 and 4 respectively.

With this arrangement there is at all times a positive bias of the locking elements, i.e. the wedges 30, into gripping engagement with the outer surface of inner tube 2 and the inner surface of the frusto-conical portion 22 of the collar 17, and this greatly facilitates installation of and adjustment of the support device in horizontal or other non-vertical configurations.

The spring 40 may be selected such that it exerts a force sufficient to hold the inner and outer tubes against relative movement pending final adjustment of the overall length of the support device to match the gap to be bridged thereby, for example that between the walls of the pipe trench or the like, or between the roof and floor of the mine tunnel, but which permits each manual adjustment of the relative position of the inner and outer tubes to enable final adjustment of the overall length of the support device to be made. As will be appreciated with the construction shown in the drawing the spring 40 is disposed between the cover and the housing and co-acts therewith in a manner normally effective to bias the locking elements, i.e. the wedges 30, into the position whereat their inner surfaces grippingly engage the outer surface of the inner tube 2.

Final and fine adjustment of the overall length of the support device is effected by means of the adjusting nut 12. Initially the adjusting nut 12 is screwed onto the threaded portion 10 of the outer tube 4 to a position whereat it is located at or adjacent the innermost end of the threaded portion 10 whereby to provide the maximum amount of adjustment of the overall length of the support device.

The collar 17 with its frusto-conical housing 22, in conjunction with the conjointly movable locking elements, i.e. the wedges 30 and associated resilient means in the form of the spring 40, together constitute an adjustable self-locking mechanism adapted to be mounted on the outer one, 4, of the pair of telescopically interfitting members, 2 and 4, in a manner permitting movement of the housing longitudinally relative to the outer member 4 to provide adjustment of the overall length of the support device. The locking elements 30, when inserted in the housing, in use of the support device, cooperating therewith to interlock said telescopically interfitting members 2 and 4 against longitudinal movement relative to one another.

In an alternative arrangement, not shown, the adjusting nut 12 may be fitted over a complementary screw-threaded member which latter is attachable in a non-rotatable manner to end portion 10 of member 4 in which case end portion 10 would not be threaded as in the illustrated embodiments. This arrangement would be particularly, although not exclusively, suitable where the telescopically interfitting members 2 and 4 are of non-circular cross-section.

An aperture 52 is formed in the peripheral wall of outer tube 4 and enables the position of the inner tube 2 therein to be monitored, it being desirable that the end of inner tube 2 extend into outer tube 4 to at least the centre of the aperture 52. This arrangement ensures that a minimum length of inner tube 2 is housed and extends within the open end of outer tube 4 to provide the required overall strength and rigidity of the support device.

In operation the support device, which as illustrated is in the form of a prop, is struck to the approximate length required, for example the span to be bridged, by moving the inner tube 2 outwardly relative to the outer tube 4, against the bias of the spring 40 which latter exerts a force which is normally sufficient to hold the tubes 2 and 4, via the wedges 30, against relative movement but which permits easy manual adjustment of the relative position of the two tubes and thus of the overall length of the support device constituted by the telescopically interfitting tubes 2 and 4. With the support device, i.e. the prop, thus adjusted to its approximate desired overall length final adjustment is effected by pivoting the handle 14 about pin 15 to its operative position whereat it extends in a direction normal to the longitudinal axis of the support device, whereafter rotation thereof in an anti-clockwise direction is effective to move the adjusting nut along the threaded portion 10 towards the open end of outer tube 4. Movement of the adjusting nut in this direction serves to move the locking mechanism with entrained inner tube 2 in the same direction relative to the outer tube 4 and thereby increase the overall length of the support device by the required amount to provide a final adjustment thereof. Upon completion of the final adjustment of the overall length of the prop, the handle 14 may be pivoted about pin 15 to its collapsed position, as shown in the drawing, where it extends parallel to the longitudinal axis of the support device.

To release the prop it is simply necessary to rotate the adjusting nut via handle 14 (conveniently pivoted about pin 15 to its operative position) in a clockwise direction to reduce the overall length of the support device whereafter the two tubes, 2 and 4, constituting the support device may be manually telescoped one within the other against the bias exterted on the locking wedges 30 by the spring 40 and the support device can then be collapsed and removed.

We claim:

1. A self-locking adjustable support device comprising:

(a) two telescopically interfitting members;

(b) a housing;

(c) means connecting the housing to one end of one of said telescopically interfitting members in a manner permitting the housing to be adjusted in position longitudinally relative to said one member;

(d) said housing being formed with a portion having an internal frusto-conical surface arranged to receive therein a plurality of locking elements;

(e) said connecting means permitting rotation of said housing relative to said one member about its longitudinal axis to permit adjustment of the overall length of the support device;

(f) a cover member adapted to circumjace the free end of said housing with said locking elements depending therefrom into a space defined between said internal frustoconical surface of said housing and the outer surface of said other one of said telescopically interfitting members; and (g) resilient means disposed within said cover member and normally effective to bias said cover member away from said one member and said locking elements to positions within said housing whereat they are in gripping engagement with said other one of said telescopically interfitting members so as to inhibit movement of said other member in one direction longitudinally relative to said one member.

2. An adjustable self-locking mechanism for use in association with a support device having two telescopically interfitting members, said mechanism comprising:

(a) a housing arranged to be connected to one end of the outer one of said telescopically interfitting members in a manner permitting said housing to be adjusted in position longitudinally relative to the other of said members to permit adjustment of the overall length of the support device;

(b) said housing having a portion defining an internal frusto-conical surface;

(c) a cover member adapted to circumjace the portion of the housing defining the internal frusto-conical surface;

(d) a plurality of locking elements depending from the cover member into a space defined between said internal frusto-conical surface of said housing and the outer surface of said other one of said telescopically interfitting members; and (e) resilient means disposed within said cover member and normally effective to bias said cover member away from said one member and said locking elements to positions within said housing whereat they effect a jamming connection between said internal frusto-conical surface of said housing and an outer surface of said other of said telescopically interfitting members whereby to inhibit relative movement between said telescopically interfitting members.

3. A support device as claimed in claim 1, wherein said locking elements are in the form of wedge-shaped members.

4. A support device as claimed in claim 1, wherein said means connecting the housing to said one of said telescopically interfitting members comprises an internally threaded element arranged to threadedly to engage an externally threaded portion formed at one end of said one member.

5. A support device as claimed in claim 4, wherein said internally threaded element is formed with an annular groove internally thereof and said housing is provided at one end with a protuberant surface adapted to engage in said groove to permit relative rotation but to inhibit relative longitudinal movement between said housing and said internally threaded element.

6. A support device as claimed in claim 4, wherein said internally threaded element is provided with a handle member to facilitate rotation of said internally threaded element relative to said one member through its threaded engagement therewith whereby to permit adjustment of the housing longitudinally relative to said one member.

7. A support device as claimed in claim 1, wherein said locking elements are pivotally connected to said cover member.

8. A support device as claimed in claim 1, wherein said cover member comprises a centrally apertured plate and has an annular skirt secured thereto and depending therefrom at or adjacent the outer peripheral edge thereof.

9. A support device as claimed in claim 8, wherein a neck portion extends from the central aperture of said plate coaxially therewith and in a direction opposite to that in which said skirt extends from said plate, said neck portion being arranged to form a snug fit around said one member.

* * * * *